US011271308B2

(12) United States Patent
Pelrine et al.

(10) Patent No.: US 11,271,308 B2
(45) Date of Patent: Mar. 8, 2022

(54) DIAMAGNETIC MECHANICALLY BASED ANTENNA

(71) Applicant: SRI INTERNATIONAL, Menlo Park, CA (US)

(72) Inventors: Ronald E. Pelrine, Longmont, CO (US); Annjoe Wong-Foy, Pacifica, CA (US); Allen L. Hsu, Mountain View, CA (US)

(73) Assignee: SRI International, Menlo Park, CA (US)

( * ) Notice: Subject to any disclaimer, the term of this patent is extended or adjusted under 35 U.S.C. 154(b) by 467 days.

(21) Appl. No.: 16/122,650

(22) Filed: Sep. 5, 2018

(65) Prior Publication Data

US 2019/0089059 A1 Mar. 21, 2019

Related U.S. Application Data

(60) Provisional application No. 62/554,160, filed on Sep. 5, 2017.

(51) Int. Cl.
*H01Q 1/00* (2006.01)
*H01Q 7/06* (2006.01)
(Continued)

(52) U.S. Cl.
CPC ..... *H01Q 7/06* (2013.01); *H01Q 1/36* (2013.01); *H01Q 3/04* (2013.01)

(58) Field of Classification Search
None
See application file for complete search history.

(56) References Cited

U.S. PATENT DOCUMENTS 4,669,823 A * 6/1987 Iguma ..... G11B 7/0932 359/814
4,723,735 A * 2/1988 Eisenhaure ..... B64G 1/283 244/165

(Continued)

OTHER PUBLICATIONS

Vital Alert, Overview Canarycommpac, https://vitalalert.com/wp-content/uploads/2015/09/CanaryCommPac2017.pdf, access date Jun. 20, 2017.

*Primary Examiner* — Trinh V Dinh
(74) *Attorney, Agent, or Firm* — McDonnell Boehnen Hulbert & Berghoff LLP

(57) ABSTRACT

Systems are provided for the efficient generation of oscillating magnetic fields below the Low Frequency band. These systems generate such fields by mechanically rotating one or more diametrically-magnetized permanent magnets. In order to reduce friction, the magnets are rotated by applying a motive magnetic field to the magnet(s) to rotate the magnet(s) and thereby generate the oscillating magnetic field. Additionally, diamagnetic repulsion, active magnetic field control, and/or biasing permanent magnets are employed to levitate the rotating magnet(s), further reducing friction and increasing system efficiency. These systems may be employed to generate modulated low-frequency oscillating magnetic fields for communication through seawater, rocks, or other obstacles. Additionally or alternatively, these systems may be employed to generate low-frequency oscillating magnetic fields for navigation and location sensing, resource identification and extraction, or other applications.

20 Claims, 7 Drawing Sheets

(51) Int. Cl.
*H01Q 3/04* (2006.01)
*H01Q 1/36* (2006.01)

(56) References Cited

U.S. PATENT DOCUMENTS 5,332,967 A * 7/1994 Shporer ..... G01R 33/341 324/300
5,635,784 A * 6/1997 Seale ..... A61B 8/12 310/40 MM
6,020,665 A * 2/2000 Maurio ..... F16C 32/0444 310/90.5
6,249,067 B1 * 6/2001 Schob ..... F16C 32/0446 310/68 B
8,203,316 B2 * 6/2012 Lemmers, Jr. ..... F16F 15/035 322/4
8,593,016 B2 11/2013 Pelrine et al.
8,686,602 B2 4/2014 Pelrine et al.
9,231,799 B2 1/2016 Roper et al.
9,647,523 B2 5/2017 Pelrine et al.
9,752,615 B2 * 9/2017 Hosek ..... F16C 32/0493
10,044,253 B2 8/2018 Pelrine et al.
2001/0030471 A1 * 10/2001 Kanebako ..... F16C 32/0493 310/90.5
2003/0038552 A1 * 2/2003 Setiawan ..... F16C 32/0451 310/90.5
2004/0050180 A1 * 3/2004 Abe ..... G01D 5/2053 73/862.331
2004/0262074 A1 * 12/2004 Nagase ..... B62D 5/046 180/446
2006/0127074 A1 * 6/2006 Noji ..... H04N 5/23248 396/55
2007/0065169 A1 * 3/2007 Kandori ..... G03G 15/5037 399/73
2007/0206259 A1 * 9/2007 Nakajima ..... G02B 26/105 359/199.1
2009/0001843 A1 * 1/2009 Enomoto ..... H02K 1/145 310/257
2009/0243413 A1 * 10/2009 Gilchrist ..... H02K 7/09 310/90.5
2012/0127576 A1 * 5/2012 Tanaka ..... G02B 27/646 359/557
2013/0015731 A1 * 1/2013 Griffin ..... F16C 32/0442 310/58
2016/0372988 A1 * 12/2016 Sekii ..... H02K 7/02
2017/0322585 A1 * 11/2017 Tomita ..... G01C 21/3664
2018/0114621 A1 4/2018 Pelrine et al.
2019/0057782 A1 * 2/2019 Wong ..... G21B 1/21

* cited by examiner

DIAMAGNETIC MECHANICALLY BASED ANTENNA

CROSS-REFERENCE TO RELATED APPLICATION

This application claims priority to U.S. Provisional Patent Application No. 62/554,160, filed Sep. 5, 2017, which is incorporated herein by reference.

FEDERAL FUNDING LEGEND

This invention was made with Government support under contract number HR001117C0109 awarded by the Defense Advanced Research Projects Agency. The Government has certain rights in this invention.

BACKGROUND

Unless otherwise indicated herein, the materials described in this section are not prior art to the claims in this application and are not admitted to be prior art by inclusion in this section.

Low-frequency electromagnetic fields (e.g., propagating and/or non-propagating electromagnetic fields that oscillate at a frequency below the Low Frequency (LF) band from 30-300 kHz) can penetrate a variety of materials, including seawater and rock. Accordingly, such low-frequency electromagnetic fields could provide benefits in a variety of applications, including communications (e.g., with submarines, with transceivers located underground), navigation/location (e.g., of devices located underground or underwater), resource detection and extraction (e.g., metal detection or otherwise probing the composition of underground materials or structures), or other applications.

However, it can be difficult to generate such low-frequency waves. Efficient antennas or other radiators are often very large, with dimensions in the kilometers to match the extremely long wavelength of such low-frequency waves. Currently available methods for generating such low-frequency oscillating fields are often extremely inefficient, necessitating large generators or other sources of power.

Note that Low Frequency or LF is the ITU designation for radio frequencies (RF) in the range of 30 kilohertz (kHz)-300 kHz. As its wavelengths range from ten kilometers to one kilometer, respectively, it is also known as the kilometer band or kilometer wave.

SUMMARY

Some embodiments of the present disclosure provide an apparatus for efficiently generating penetrating, time-varying magnetic fields at frequencies below the Low Frequency (LF) band, the apparatus including: (i) a magnet configured to rotate about an axis of rotation, where at least a portion of the magnet is magnetized in a direction non-parallel to the axis of rotation; and (ii) a coil, where the coil is disposed proximate to the magnet such that an electrical current through the coil produces a magnetic field that causes the magnet to rotate about the axis of rotation.

This apparatus can include additional elements, for example, a diamagnetic material (e.g., pyrolytic graphite) disposed proximate to the magnet and configured to levitate the magnet. A portion of the magnet can be radially magnetized, and the apparatus can additionally include a bias magnet disposed proximate to the radially magnetized portion of the magnet such that the bias magnet levitates the magnet. The apparatus can include a second magnet that is configured to rotate about an axis of rotation and that is magnetized in a direction non-parallel to its axis of rotation, its axis of rotation being substantially parallel to the axis of rotation of the first magnet. Such an apparatus can include a second coil disposed proximate to the additional magnet such that an electrical current through the second coil produces a magnetic field that causes the second magnet to rotate about the axis of rotation of the second magnet. The apparatus can include additional second and third coils disposed proximate to the magnet such that electrical currents through the second or third coils produce magnetic fields that cause the magnet to rotate about the axis of rotation. In such an embodiment, the magnet can be disposed between the second and third coils such that time-varying electrical currents can be applied through the first coil, the second coil, and the third coil to rotate the magnet about the axis of rotation, to levitate the magnet, and to stabilize the location of the magnet relative to the first, second, and third coils. The apparatus can include a controller operably coupled to the coil(s) and configured to apply time-varying electrical current(s) through the coil(s) to rotate the magnet about the axis of rotation, to modulate a speed of rotation of the magnet, to levitate the magnet, and/or to apply stabilizing forces to the magnet to maintain the magnet at a specified location relative to the coil(s). The apparatus can include one or more sensors such that the controller can operate the sensor(s) to detect a location of the magnet relative to the coil(s) and to apply time-varying electrical currents through the coil(s), based on the detected location of the magnet, to control a magnitude of a force applied, via the coil(s), to levitate the magnet in order to maintain the magnet at a specified location relative to the coil(s). The apparatus can include a ferromagnetic material that is disposed proximate to the magnet such that rotation of the magnet induces a time-varying magnetization in the ferromagnetic material. The magnet can be a cylinder of magnetized material having a diameter less than three millimeters.

Some embodiments of the present disclosure provide a method for efficiently generating penetrating, time-varying magnetic fields at frequencies below the LF band, the method including: applying a time-varying electrical current through a coil disposed proximate to a magnet such that the coil produces a magnetic field that causes the magnet to rotate about an axis of rotation, where the magnet is magnetized in a direction non-parallel to the axis of rotation.

The method can include receiving a modulation signal, and applying the time-varying electrical current through the coil can include applying a time-varying electrical current through the coil such that a speed of rotation of the magnet about the axis of rotation varies according to the modulation signal. The method can include applying a time-varying electrical current to a second coil such that the second coil produces a second magnetic field, wherein the second coil is disposed proximate to a second magnet that is configured to rotate about an axis of rotation and that is magnetized in a direction non-parallel to the axis of rotation of the second magnet such that the produced second magnetic field causes the second magnet to rotate about the axis of rotation of the second magnet in a direction opposite a direction of rotation of the first magnet, where the axis of rotation of the first magnet and the axis of rotation of the second magnet are substantially parallel. The method can include applying a time-varying electrical current to a second coil such that the second coil produces a second magnetic field, wherein the second coil is disposed proximate to a second magnet that is configured to rotate about an axis of rotation and that is magnetized in a direction non-parallel to the axis of rotation of the second magnet such that the produced second magnetic field causes the second magnet to rotate about the axis of rotation of the second magnet in a direction that is the same as a direction of rotation of the first magnet, wherein the axis of rotation of the first magnet and the axis of rotation of the second magnet are substantially parallel. The method can include, when a second coil is disposed proximate to the magnet such that an electrical current through the second coil produces a magnetic field that causes the magnet to rotate about the axis of rotation, a third coil is disposed proximate to the magnet such that an electrical current through the third coil produces a magnetic field that causes the magnet to rotate about the axis of rotation, and the magnet is disposed between the second and third coils, applying time-varying electrical currents through the first coil, the second coil, and the third coil to rotate the magnet about the axis of rotation, to levitate the magnet, and to stabilize the location of the magnet relative to the first, second, and third coils. The method can include operating a sensor to detect a location of the magnet relative to the coil(s) and applying time-varying electrical currents through the coil(s) to control a magnitude of a force applied, via the coil(s), to levitate the magnet in order to maintain the magnet at a specified location relative to the coil(s). The method can include applying a time-varying electrical current through the coil such that a speed of rotation of the magnet exceeds 1000 rotations per second.

These as well as other aspects, advantages, and alternatives, will become apparent to those of ordinary skill in the art by reading the following detailed description, with reference where appropriate to the accompanying drawings.

DETAILED DESCRIPTION

Figure 1A:
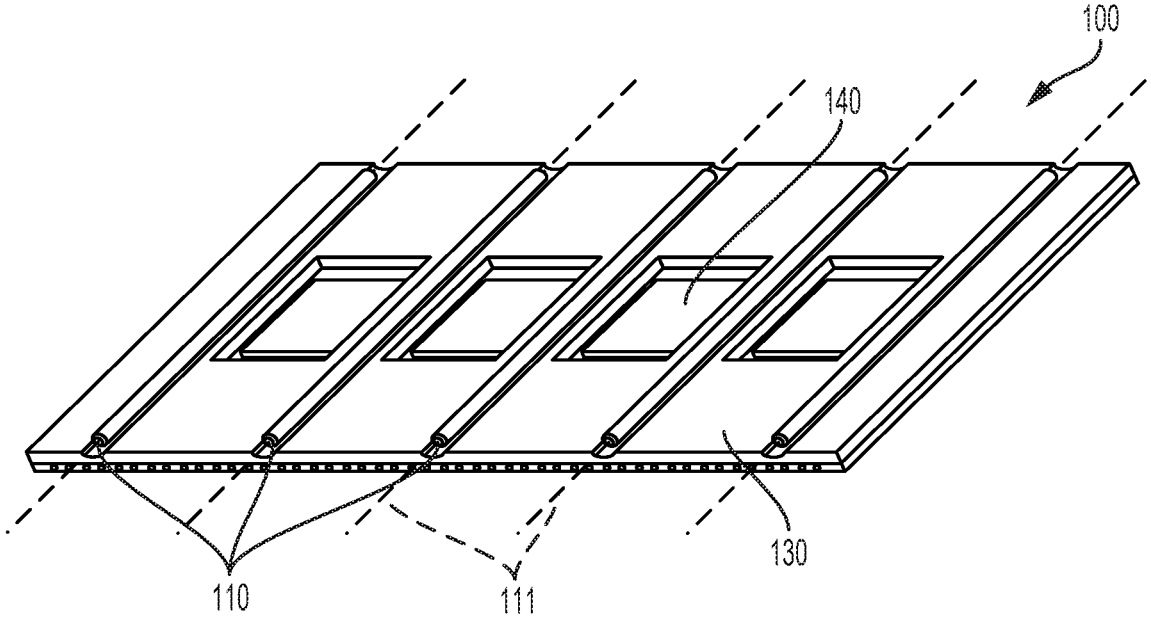
FIG. 1A is a perspective, disassembled view of elements of an example transmitter system.

In the following detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

I. Overview

Oscillating electric, magnetic, and/or electromagnetic fields (e.g., propagating electromagnetic waves) interact with matter or other obstacles in a manner that can be frequency-dependent. Generally, lower-frequency oscillating fields (e.g., magnetic fields that oscillate at frequencies below the Low Frequency (LF) band, which extends between 30 kHz and 300 kHz) are better able to penetrate rock, sea water, or other obstacles more and/or to penetrate such obstacles through a greater distance than higher-frequency oscillating fields. Accordingly, low-frequency oscillating fields may be used where penetration of such obstacles is advantageous, e.g., to communicate with submarines and/or transmitters located underground, to navigate and/or locate transmitters underground or underwater, to detect the presence of resources underground or underwater (e.g., using techniques of metal detection or other resource detection techniques), or other applications.

However, such low-frequency oscillating fields can be difficult to generate. The wavelength of such fields is very long (e.g., kilometers to hundreds of kilometers), so radiative antennas may be prohibitively large (e.g., on the order of hundreds of meters to kilometers). Additionally or alternatively, methods for generating low-frequency oscillating electric and/or magnetic fields, such as electromagnets, may be very inefficient, requiring significant amounts of power in order to generate fields at useful magnitude. As a result, such systems may require access to mains power, generators, or other large power sources, making the generation of such low-frequency oscillating fields by portable equipment difficult.

This disclosure provides embodiments for generating such low-frequency (e.g., less than 3 kHz, or less than 1 kHz) oscillating magnetic fields in a manner that is efficient, low-weight, and low-volume. In example embodiments, a permanent magnet is mechanically rotated about an axis of rotation such that the dipole moment of the permanent magnet rotates in a plane that is substantially perpendicular to the axis of rotation. For instance, the permanent magnet could be in the shape of a cylinder, the axis of rotation could be the long axis of the cylinder, and the dipole moment could be in a radial direction perpendicular to, or otherwise non-parallel with, the axis of rotation. By rotating the dipole moment of the permanent magnet, the magnetic field produced by the permanent magnet also rotates. This results in an oscillating magnetic field that can be used, e.g., to communicate (e.g., by modulating the rate of the rotation), to detect the presence of materials in the ground or seawater (e.g., by exciting the materials magnetically and detecting the response due to such excitation), or to enable some other application of such a controllable, penetrating magnetic field.

Example embodiments can operate with fewer mechanical bearings, or can avoid the use of mechanical bearings altogether, in order to increase the efficiency with which the oscillating magnetic fields are generated, to reduce the generation of audible noise or vibration, to prevent friction noise from being introduced into the oscillating magnetic field, or to provide some other benefits. To achieve this, one or more coils can be used to drive the rotation of the permanent magnets directly by generating time-varying magnetic fields that act on the magnetic dipole of the permanent magnet (e.g., instead of using a high-speed motor to drive the rotation of the permanent magnet) to rotate the permanent magnet at a specified speed (e.g., at a speed greater than 1000 rotations per second). Such coil(s) may also be used to apply a levitational force to the permanent magnet and/or to stabilize the location of the rotating permanent magnet within an apparatus. In some embodiments, a system includes 6-8 coils. But it can be appreciated that a greater or lesser number of coils can be arranged about a rotor to achieve desired fields and/or applied forces or torques. In some embodiments, the coils disclosed have between 5 and 40 turns. In other embodiments, the coils disclosed have between 10 and 30 turns.

Additional levitational forces may be applied to the permanent magnet via passive means, e.g., by repulsion from diamagnetic materials (e.g., pyrolytic carbon) and/or by repulsion or attraction by one or more biasing permanent magnets. The use of diamagnetic repulsion may also provide passive stabilization of the rotating magnet within an apparatus Embodiments provided herein may generate larger magnitude oscillating magnetic fields by including more rotating permanent magnet material. This can include increasing the diameter and/or length of the rotating permanent magnets. Additionally or alternatively, multiple rotating permanent magnets may be included in a single apparatus, e.g., driven by respective sets of one or more coils. Such rotating magnets could be arranged in a planar array or in some other arrangement. The magnets of such an apparatus could rotate in the same direction or in opposite directions, e.g., to control a directionality of the oscillating magnetic field generated by the apparatus. Additionally or alternatively, one or more poles of soft ferromagnetic material could be disposed proximate the one or more rotating magnets, such that magnetization induced in the ferromagnetic material by rotation of the nearby permanent magnet results in an increase in magnitude of the overall oscillating magnetic field generated by the apparatus.

II. Example Oscillating Magnetic Field Transmitters/Generators

Embodiments provided herein include rotating permanent magnets, thereby generating a low-frequency oscillating magnetic field (as the dipolar field produced by the permanent magnet is rotated) that can be used, e.g., to communicate, to interrogate materials, to determine the location of objects, to act as a beacon, to provide inductive heating, or to provide some other benefit. The use of rotating permanents magnets to generate such low-frequency oscillating magnetic fields (e.g., at frequencies below the LF band) permits the fields to be generated more efficiently than by alternative methods, e.g., by driving an electrical coil or other antenna at a low frequency. These embodiments additionally include using one or more coils, disposed near the rotating permanent magnets, to generate time-varying fields to drive the rotation of the permanent magnets directly by exerting a torque on the magnetic dipole of the permanent magnets. Driving the rotation in this way permits the magnets to be rotated more efficiently than by alternative methods, e.g., by using a separate motor, coupled to the permanent magnet(s), to drive the rotation of the magnet(s). Further yet, driving permanent magnetic elements in a rotational fashion permits the oscillating magnetic field to be generated more efficiently, and with less acoustical noise generated, than if the permanent magnetic elements were mechanically driven in an oscillatory fashion.

Figure 1B:
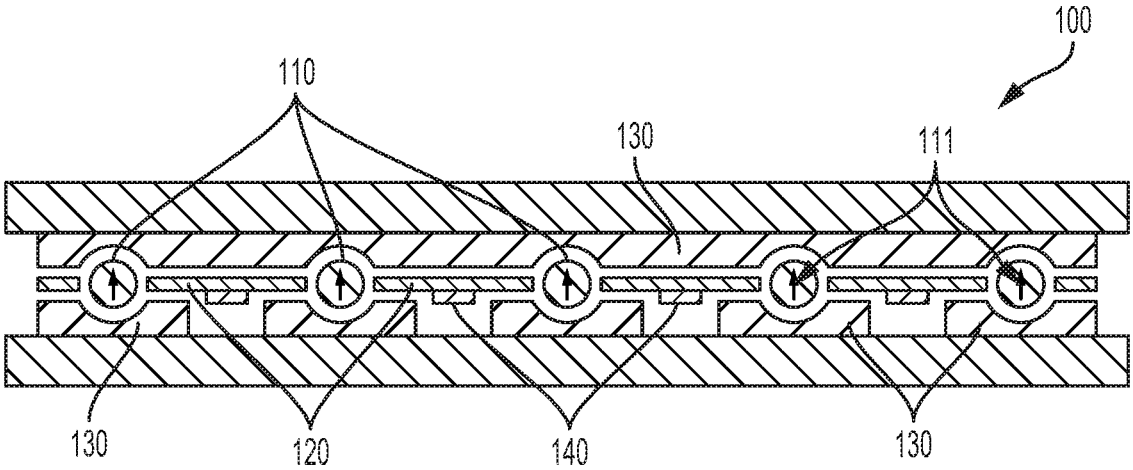
FIG. 1B is a cross-sectional view of the transmitter system shown in FIG. 1A.

FIGS. 1A and 1B illustrate an example device 100 that includes a plurality of permanent magnets 110. FIG. 1A shows a perspective view of the device 100 (with the layers above the permanent magnets 110 omitted) and FIG. 1B shows a cross-sectional view of the device 100 through the permanent magnets 110. In this example, each of the permanent magnets 110 is in the shape of a cylinder, and the device 100 is configured to rotate each of the cylindrical permanent magnets 110 about a respective axis of rotation 111 that corresponds to the long axis of the cylinder. Such rotatable permanent magnets may alternatively be referred to as "rotors" herein. While non-cylindrical shapes may be employed for such rotors, the amount of power needed to modulate or spin-up the rotor is reduced by disposing permanent magnetic material close to the rotation axis (thereby reducing the rotational moment of inertia of the rotor). The permanent magnets 110 are magnetized in a direction non-parallel (e.g., perpendicular) to this axis of rotation (illustrated by the arrows in FIG. 1B). As a result, when the permanent magnets 110 are rotated about their axes of rotation, their respective magnetic fields are also rotated, generating an oscillating magnetic field that oscillates in time with the rotation of the permanent magnets 110. Such permanent magnets, being magnetized in a direction perpendicular (or some other non-parallel direction) to their long axes, may be referred to as diametrically magnetized. Pairs of the permanent magnets 110 could be rotated in the same direction or in opposite directions. For example, the direction of rotation of the permanent magnets 110 in the device 100 could alternate from one magnet to the next.

Note that a device as described herein could include a greater or fewer number of permanent magnets than the example device 100. For example, a device could include dozens of rotating permanent magnets (e.g., 10-50 permanent magnets, 300 or more permanent magnets) to generate a low-frequency, oscillating magnetic field. In another example, a device could include a single permanent magnet that could be rotated to generate a low-frequency, oscillating magnetic field. The number of such permanent magnets and the properties thereof (e.g., magnetic properties or composition, dimensions, geometry) could be specified according to a particular application. For example, an overall amount of magnetic material of such a device could be specified according to a desired magnitude of the generated oscillating magnetic field. For example, to generate a 100 femto-tesla RMS magnetic field at a distance of 1 kilometers, a device could include at least 4.6 kilograms of rare-earth magnetic material having a dipole moment density of 1150 kA-$m^2/m^3$.

In order to reduce a rotational inertia of the permanent magnets about the axis of rotation, e.g., to increase the efficiency and/or reduce the power with which the rotational rate of the permanent magnets can be altered, the number of permanent magnets composed of magnetic material could be increased and/or the diameter of such permanent magnet(s) could be decreased. Accordingly, the efficiency of bringing the permanent magnets up to speed and/or of modulating the rotational rate of the permanent magnets (e.g., to effect modulation of the generated oscillating magnetic field for purposes of communications) could be increased and/or the power required to do so could be decreased. In an example, the diameter of such rotating permanent magnets could be less than 3 millimeters.

The device 100 also includes elements configured to rotate the permanent magnets 110 and to levitate the permanent magnets 110 (e.g., in order to increase the efficiency of rotation of the magnets and/or or reduce friction noise in the oscillating magnetic field generated therefrom by reducing friction between the permanent magnets 110 and other elements of the device 100). To achieve this, device 100 includes one or more coils (not shown) disposed proximate to each of the permanent magnets 110 such that time-varying electrical currents may be applied to the one or more coils in order to cause the respective permanent magnets 110 to rotate about their respective axes of rotation (e.g., by generating magnetic fields that exert a rotating torque on the magnetic dipoles of the permanent magnets 110). The coils could be wound wire coils, traces formed on one or more printed circuit boards (PCBs) 120 of the device 100, and/or coils having some other configuration (e.g., coils fabricated on flexible PCBs). Electronics 140 of the device are configured to apply such electrical currents to rotate the permanent magnets 110 and/or to perform some other functions.

Note that the arrangement, in FIGS. 1A and 1B, of a number of rotatable permanent magnets in a planar array is intended as a non-limiting example embodiment of how a plurality of such permanent magnets could be arranged in a device. An array of such permanent magnets could be arranged in a three-dimensional array (e.g., a hexagonal array of rotatable, cylindrical permanent magnets) or arranged in some other manner according to an application. The arrangement of the permanent magnets could be specified to reduce a volume and/or some other dimension of the device, to increase the magnitude of the low-frequency oscillating magnetic field generated by the device, to reduce a cost of manufacturing the device, or to satisfy some other factor or combination of factors. The spacing between such multiple rotors could be greater than a minimum distance, in order to reduce the interference that the rotors may exert on each other during operation of such a device.

The device 100 additionally includes elements configured to levitate the permanent magnets 110. This includes amounts of a diamagnetic material 130 (e.g., pyrolytic graphite or bismuth) disposed proximate to the permanent magnets 110 such that a repulsive, levitating force is applied between the diamagnetic material and the permanent magnets 110. The geometry of such a diamagnetic material could also be specified to exert a stabilizing force on the permanent magnets 110, e.g., to maintain the permanent magnets 110 at respective locations within the device 110. The one or more coils disposed proximate to the permanent magnets 110 could also be configured and/or operated to exert levitating and/or stabilizing forces on respective permanent magnets 110. Such levitation and/or stabilization could be operated based on the output of one or more sensors (e.g., optical sensors, magnetic sensors) configured to detect the locations of the permanent magnets 110 and/or based on back-EMF detected via the one or more coils. In some embodiments, the configuration and composition of diamagnetic material 130 proximate to the permanent magnet rotors 110 may permit the rotors 110 to be rotated at high speeds according to an open-loop control strategy (e.g., not based on feedback related to the detected rotation and/or location of the rotors) due to the stabilizing levitational effects of the diamagnetic material 130.

As used herein, a device or element "levitating" a permanent magnet includes the device or element exerting a force on the permanent magnet to partially or fully counteract the force of gravity that is acting on the permanent magnet. For example, the diamagnetic material 130 of the device 100 "levitating" one of the permanent magnets 110 could include the diamagnetic material 130 exerting a force on the permanent magnet sufficient to fully counter the force of gravity on the permanent magnet. Alternatively, the diamagnetic material 130 of the device 100 "levitating" one of the permanent magnets 110 could include the diamagnetic material 130 exerting a force on the permanent magnet that is insufficient to fully counter the force of gravity on the permanent magnet. In such an example, some other means (e.g., levitational force exerted by currents applied through one or more coils, a levitational force applied by biasing permanent magnet on a radially-magnetized segment of the permanent magnet) could provide additional levitational force such that total levitational force applied to the permanent magnet is sufficient to fully counter the force of gravity on the permanent magnet. The diamagnetic material 130 may also exert stabilizing forces on the permanent magnets 110 (e.g., forces tending to maintain the permanent magnets 110 at respective specified locations within the device 100) such that the permanent magnets 110 may be rotated in an open-loop fashion and/or in a closed-loop fashion using lower-quality sensor information (e.g., with respect to sensor noise, accuracy, latency, or bandwidth) than if the stabilizing effect of the diamagnetic material 130 was not present.

The device 100 may include additional elements, or may operate the aforementioned elements, in order to reduce damage to the device and/or improve operation of the device in response to mechanical movement or shocks experienced by the device 100. For example, the device 100 could include mechanical brakes or other element configured to secure the permanent magnet rotors 110 of the device 100 when the device is being transported, when the device is being subjected to a shock, a fall, or some other motion (e.g., in response to operating one or more accelerometers and/or gyroscopes of the device 100 to detect such motions). Additionally or alternatively, one or more coils of the device 100 (e.g., one or more coils used to rotate the permanent magnets 110 and/or to levitate the permanent magnets) could be operated to stabilize the location of the permanent magnets 110 within the device 100, e.g., in a feedback fashion based on one or more sensors configured to detect the location of the permanent magnets and/or to detect motion of the overall device 100.

In order to increase an efficiency of operation, to reduce the power of operation, to reduce the presence of friction-related noise in generated oscillating magnetic fields, or to provide some other benefit, an apparatus as described herein (e.g., device 100) could be configured to include one or more low-friction bearings in order to reduce the friction experienced, during rotation, by one or more permanent magnet rotors of the apparatus. In some examples, this could include the permanent magnet rotors and/or surfaces of the apparatus that are proximate thereto being polished, including a surface coating, treatment, or texture, or being otherwise configured such that high-speed rotation of the permanent magnet rotors results in an air bearing effect, levitating the permanent magnet rotors and/or preventing the permanent magnet rotors from coming into contact with other elements of the apparatus. Additionally or alternatively, a ferrofluid bearing, a magnetic bearing, and/or some other variety of low-friction bearing could be included in such an apparatus.

Figure 2A:
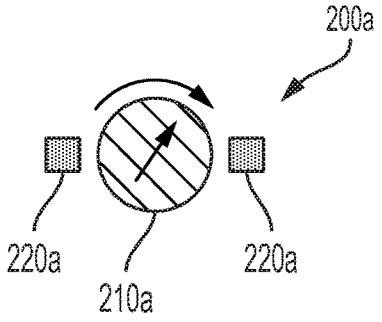
FIG. 2A is a cross-sectional view of elements of an example transmitter system.

A variety of methods could be employed to drive the rotation of permanent magnet rotors in an efficient manner. This can include applying a time-varying current through a coil disposed proximate to such a permanent magnet rotor in order to rotate the permanent magnet rotor. This is illustrated in FIG. 2A, which is a cross-sectional view of a device 200*a* that includes a permanent magnet 210*a* and a coil 220*a*. The permanent magnet 210*a* has a cylindrical geometry and coil 220*a* is configured such that, when a current is passed through the coil 220*a* and the dipole moment of the permanent magnet 210*a* is not aligned with the dipole moment generated by the coil 220*a*, a torque is exerted on the permanent magnet 210*a*, thus causing the permanent magnet 210*a* to rotate about an axis of rotation corresponding to the long axis of the permanent magnet 210*a*. The permanent magnet 210*a* is magnetized in a direction perpendicular to this axis of rotation (illustrated by the arrow in FIG. 2A) such that, when the permanent magnet 210*a* is rotated about its axis of rotation, its magnetic field is also rotated, generating an oscillating magnetic field that oscillates in time with the rotation of the permanent magnet 210*a*. The current applied through the coil 220*a* could be controlled to modulate a speed of rotation of the permanent magnet 210*a* about the axis of rotation over time. Such modulation may be effected, e.g., to communicate information to a remote device that is configured to detect the modulated low-frequency oscillating magnetic field generated by the device 200*a*. The coil 220*a* could be wound from wire, formed as traces on a PCB or on some other substrate, or may be composed of some other material and/or formed in some other manner.

Such a coil (e.g., 220*a*) of a device could be configured to also provide a levitating and/or a stabilizing force on a permanent magnet rotor, e.g., by being located off-center relative to the permanent magnet, by including one or more additional loops proximate to the permanent magnet, or by being configured and/or operated in some other manner. In examples wherein one or more coils are employed to levitate and/or stabilize the location of a permanent magnet rotor, such coils can be controlled based on information detected about the location and/or rotation of the permanent magnet rotor. Such information may be detected using optical, magnetic, and/or some other type of sensors configured to detect the location, orientation, presence, or some other information about the permanent magnet rotor. Additionally or alternatively, the one or more coils may be operated to detect such information about the permanent magnet rotor, e.g., by detecting a back EMF present on the coil(s), by applying an alternating electrical current to detect the effective impedance of the coil(s), or via some other method.

A variety of methods may be employed in order to levitate such a permanent magnet rotor, in order to increase the efficiency with which the rotor may be rotated, to reduce wear and tear on the rotor and/or related elements, to reduce friction noise in the oscillating magnetic fields generated using the permanent magnet rotor, or to provide some other benefit. In some examples, an amount of a diamagnetic material may be provided proximate to the permanent magnet rotor. The presence of such a diamagnetic material can result in a repulsive force between the diamagnetic material and the permanent magnet rotor. This repulsive force can wholly or partially counteract the force of gravity on the permanent magnet rotor, thus levitating the permanent magnet rotor. This diamagnetic repulsion may additionally provide a stabilizing force to the permanent magnet rotor, maintaining it at a specified location within a device (e.g., within a channel wholly or partially formed from the diamagnetic material). Such a diamagnetic material can include pyrolytic graphite, bismuth, and/or other material that is sufficiently diamagnetic to provide a useful diamagnetic repulsive force.

Figure 2B:
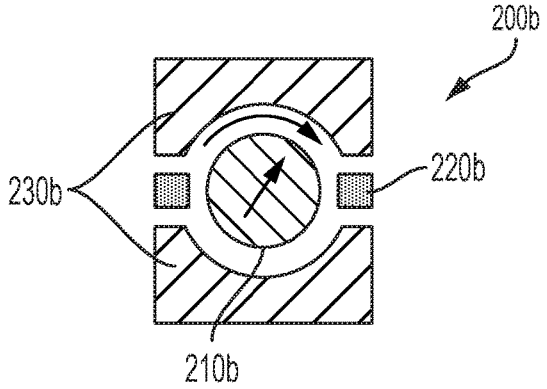
FIG. 2B is a cross-sectional view of elements of an example transmitter system.

Aspects of such an apparatus are illustrated in FIG. 2B which shows, in cross-section, a device 200*b* that includes a permanent magnet 210*b*, a coil 220*b*, and a diamagnetic material 230*b*. The permanent magnet 210*b* has a cylindrical geometry and the coil 220*b* is configured such that, when a current is passed through the coil 220*b*, a torque is exerted on the permanent magnet 210*b*, thus causing the permanent magnet 210*b* to rotate about an axis of rotation corresponding to the long axis of the permanent magnet 210*b*. The diamagnetic material 230*b* is disposed sufficiently proximate to the permanent magnet 220*b* that the diamagnetic material 230*b* acts to levitate the permanent magnet 220*b*.

Such coils (e.g., 220*b*) can provide some or all of the levitational force necessary to counteract the force of gravity. However, without active feedback control of such coil-generated forces (e.g., based on one or more sensors configured to detect the presence, location, orientation, or other information about the permanent magnet(s)), such levitational forces can lead to unstable behavior of the levitated magnet (e.g., according to the predictions of Earnshaw's Theorem). However, the presence of an appropriately-configured amount of diamagnetic material (e.g., 230*b*) proximate to the magnet can provide sufficient stabilizing forces to the permanent magnet that such a coil could be operated, in an open-loop fashion, to provide some or all of the required levitational force necessary to counteract the force of gravity on the permanent magnet.

Additionally or alternatively, passive biasing magnets could be used to provide some or all of the levitating force to counteract the force of gravity on a permanent magnet rotor. However, such biasing magnets can provide such a levitating force in an unstable manner (e.g., according to the predictions of Earnshaw's Theorem), and thus some stabilizing forces may be required (e.g., from an amount of diamagnetic material and/or from active, feedback-based control of one or more electrical coils). This is illustrated by way of example in FIG. 2C which shows, in cross-section, a device 200*c* that includes a radially-magnetized permanent magnet 215*c*, a first biasing permanent magnet 240*c*, and a second biasing permanent magnet 245*c*. The radially-magnetized permanent magnet 215*c* may formed from a single volume of magnetic material as a diametrically-magnetized permanent magnet rotor as described elsewhere herein. Alternatively, the radially-magnetized permanent magnet 215*c* could be mechanically coupled or bonded to such a diametrically-magnetized permanent magnet rotor to form a composite permanent magnet that may be rotated as described herein. The first biasing permanent magnet 240*c* exerts a repulsive levitating force on the radially-magnetized permanent magnet 215*c* and the second biasing permanent magnet 245*c* exerts an attractive levitating force on the radially-magnetized permanent magnet 215*c*. These forces may be sufficient to wholly or partially cancel out the force of gravity on a permanent magnet rotor of which the radially-magnetized permanent magnet 215*c* is a part (e.g., a continuous volume of magnetic material that includes the radially-magnetized permanent magnet 215*c* or one or more diametrically-magnetized permanent magnetic elements that are mechanically coupled to the radially-magnetized permanent magnet 215*c* and that together form a permanent magnet rotor).

Figure 2C:
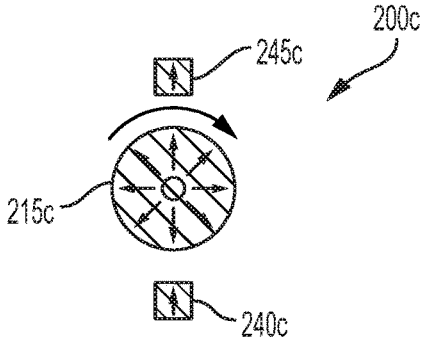
FIG. 2C is a cross-sectional view of elements of an example transmitter system.

Note that more or fewer biasing magnets could be included in the device 200*c* of FIG. 2C. Further, one or more such magnets could be replaced with or augmented by an electromagnetic coil, e.g., to permit active control of the amount and/or direction of levitational and/or stabilizing force magnetically applied to the radially-magnetized permanent magnet 215*c*.

The use of biasing magnets and/or diamagnetic materials may facilitate the passive generation of levitating and/or stabilizing forces on a permanent magnet rotor as described herein. Additionally or alternatively, electrical currents may be applied through coils disposed proximate to such permanent magnet rotors in order to exert levitating and/or stabilizing magnetic forces on the permanent magnet rotors and/or to control the rotation of the permanent magnet rotors. The use of multiple coils may permit multiple different independent degrees of freedom of the permanent magnet rotor (e.g., rotational torque and translational forces in one or more directions) to be controlled independently, e.g., by applying different electrical currents through to different coils. These electrical currents may be controlled (e.g., by one or more controllers) based on feedback related to the rotation, orientation, location, or other properties of the permanent magnet rotor(s), related to the direction of gravity relative to the permanent magnet rotor(s), and/or related to shock, translation, rotation, or other movements of an apparatus containing the permanent magnet rotor(s). Additionally or alternatively, such electrical current may be controlled in an open-loop manner, with the timing and amplitude waveform(s) of the applied current determined by a controller in a manner analogous to a stepper motor or other brushless DC motor.

Figure 2D:
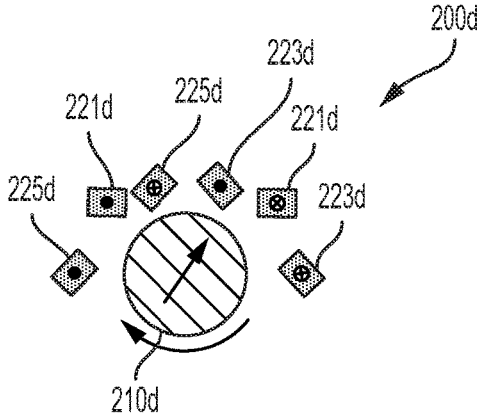
FIG. 2D is a cross-sectional view of elements of an example transmitter system.

Aspects of an apparatus that includes such multiple coils are illustrated by way of example in FIG. 2D, which shows, in cross-section, a device 200*d* that includes a permanent magnet 210*d*, a first coil 221*d*, a second coil 223*d*, and a third coil 225*d*. The direction of current through the various portions of the coils is indicated by the cross and dot symbols. The coils 221, 223*d*, 225*d* extend along the length of the permanent magnet 210*d*, having respective first and second substantially linear portions along the permanent magnet 210*d* (and through which the illustrated cross-section passes) and respective portions (not shown) that electrically connect the first and second substantially linear portions together (e.g., near the ends of the permanent magnet 210*d*). The permanent magnet 210*d* has a cylindrical geometry and the coils 221, 223*d*, 225*d* are configured such that, when a current is passed through one or more of the coils 221*d*, 223*d*, 225*d*, a torque is exerted on the permanent magnet 210*d*, thus causing the permanent magnet 210*d* to rotate about an axis of rotation corresponding to the long axis of the permanent magnet 210*d*. The permanent magnet 210*d* is magnetized in a direction perpendicular to this axis of rotation (illustrated by the arrow in FIG. 2D) such that, when the permanent magnet 210*d* is rotated about its axis of rotation, its magnetic field is also rotated, generating an oscillating magnetic field that oscillates in time with the rotation of the permanent magnet 210*d*.

The coils 221*d*, 223*d*, 225*d* are disposed relative to the permanent magnet 210*d* such that time-varying currents can be applied through the coils 221*d*, 223*d*, 225*d* to modulate a speed of rotation of the permanent magnet 210*d* about the axis of rotation over time, to control a magnitude of a levitational force applied to the permanent magnet 210*d*, and to apply stabilizing forces to the permanent magnet 210*d* in order to stabilize the location of the permanent magnet 210*d* relative to the coils 221*d*, 223*d*, 225*d*. This is achieved, at least in part, by the permanent magnet 210*d* being disposed between the second coil 223*d* and the third coil 225*d*.

Figure 2E:
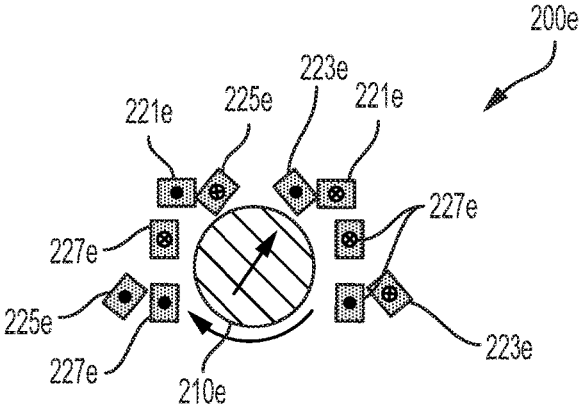
FIG. 2E is a cross-sectional view of elements of an example transmitter system.

Alternative coil arrangements, including a greater or fewer number of coils, are possible. In some examples, a single coil could include multiple loops, e.g., such that currents may be applied through the single coil to exert a levitational or other translational force on a permanent magnet rotor while exerting substantially no torque on the permanent magnet rotor. FIG. 2E illustrates, by way of example, such an alternative coil arrangement. FIG. 2E is a cross-sectional view of a device 200*e* that includes a permanent magnet 210*e*, a first coil 221*e*, a second coil 223*e*, a third coil 225*e*, and a fourth coil 227*e*. The direction of current through the various portions of the coils is indicated by the cross and dot symbols. The fourth coil 227*e* includes two loops, one on either side of the permanent magnet 210*e*, that are wound in opposite directions and connected in series in order to increase the field produced by the fourth coil 227*e* at the location of the permanent magnet 210*e* and/or in order to reduce the number of control channels allocated to control the electrical currents applied to coils associated with the permanent magnet 210*e*.

Figure 2F:
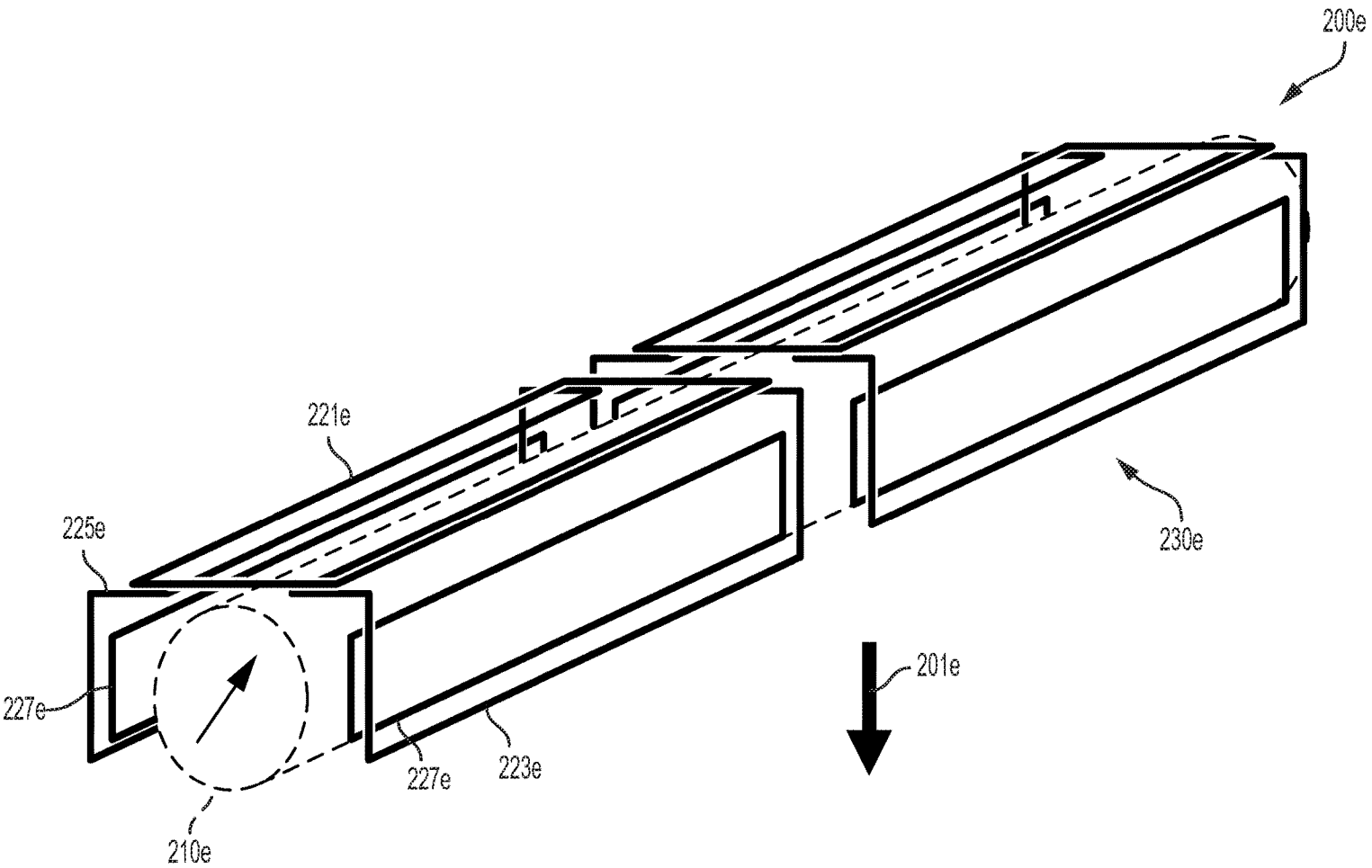
FIG. 2F is a perspective view of elements of the example transmitter system of FIG. 2E.

FIG. 2F provides a perspective view of aspects of the device 200*e* of FIG. 2E. FIG. 2F also illustrates how coils of such a device (e.g., the set of coils 221*e*, 223*e*, 225*e*, 227*e* illustrated in cross-section in FIG. 2E) may be configured to provide forces/torques to a portion of a permanent magnet rotor (e.g., a "front half" of the permanent magnet 210*e*) while other coils (a second set of coils 230*e*) are configured to provide forces/torques to another portion of the permanent magnet rotor. Such a configuration could be provided in order to provide redundancy, to reduce the voltage requirements for operation of the coils (by allowing the multiple coils to be connected in parallel), to enable independent forces/torques to be applied to different portions of the permanent magnet rotor (e.g., to enable control of the angle of the long axis of the permanent magnet rotor relative to the coils of the device), or to provide some other benefit.

The rotation, orientation, location, or other properties of the permanent magnet rotor(s), the direction of gravity relative to the permanent magnet rotor(s), and/or a shock, translation, rotation, or other movements of an apparatus containing the permanent magnet rotor(s) could be detected using a variety of sensors and used to control currents applied to coils(s) of the apparatus (e.g., to control the magnitude and/or direction of levitational and/or stabilizing forces applied to the permanent magnet rotor(s)). For example, one or more Hall sensors or other magnetometers could be used to detect the orientation, location, or presence of the permanent magnet rotor(s) and/or to detect an orientation of an ambient magnetic field (e.g., the earth's magnetic field) relative to the permanent magnet rotor(s). Additionally or alternatively one or more photodiodes, photodetectors, cameras, or other light-sensitive elements could be used to detect such information about the permanent magnet rotor(s). One or more accelerometers, gyroscopes, or other inertial measurement sensors could be used to detect the motion of the apparatus and/or to detect to direction and/or magnitude of gravity relative to the permanent magnet rotor(s).

Information detected using such sensors can also be used to automatically tune the coil currents for levitation of the rotor across a range of different rotor orientations. For a given rotor orientation, a variety of coil currents can be applied and the resulting rotor locations detected using optical, magnetic, or other types of sensors. This information, across multiple different coil currents for the given rotor orientation, can allow a controller to determine, for the given rotor orientation, a particular coil current to apply in order to stabilize and/or levitate the rotor (e.g., to cause the rotor to be located at a specified location relative to the coil(s), e.g., at a center of a substantially cylindrical cavity in which the rotor is disposed). A variety of different search methods could be employed by a controller to determine such currents, and the currents could be determined for many different orientations of the rotor (e.g., for 360 different orientations of the rotor, spaced apart by one-degree increments). Additionally or alternatively, search methods could be employed to determined currents for a number of different orientations (e.g., for 0, 90, 180, and 270 degrees with respect to a vertical orientation of the device), and the currents for additional orientations could be determined, e.g., by linear superposition of known currents, based on the difference in angle between the angle to be determined and the angles corresponding to the known currents.

An error function with respect to rotor orientation and location could be employed as part of such a search. For example, the root mean square error in rotor position could be used when the rotor is within a predetermined acceptable error in angle. In another example, the angular error may be included in the error function with suitable weighting. By using such automatic tuning techniques, the rotor may be tuned precisely and relatively quickly at many angular orientations.

As an example of a search method, coil currents can be applied, over time, across a range of current values for a particular rotor orientation. Increased current magnitudes could result in the rotor obtaining a higher vertical location, and vice versa. Vertical locations of the rotor relative to the coil(s) corresponding to the applied currents can be detected. The current level corresponding to a specified vertical location (e.g., a vertical location that is centered within a cylindrical or otherwise-configured cavity within which the rotor is disposed) can then be stored or otherwise recorded.

The tuning procedure described above may be expanded upon, e.g., to allow the current levels to be compensated for the presence of ambient magnetic fields, changes in the orientation of the rotor(s) relative to the direction of gravity (e.g., due to a device containing the rotor(s) being rotated or moved), and/or motion of a device containing the rotor(s). Certain rotor orientations may be difficult to center according to the methods described herein for a particular device (e.g., for a particular configuration of permanent magnet rotor, coil(s), and/or other elements like diamagnetic materials). This difficulty may be due, in whole or in part, to the presence of ambient magnetic fields. In some cases, these difficult-to-tune angles may simply be ignored, as the rotor can pass through the difficult-to-tune angle at high rotational speeds. Additionally or alternatively, the number of coils used to rotate, levitate, and/or stabilize the rotor may be increased. In some examples, such additional coils may be provided in order to allow for the cancellation of ambient magnetic fields.

During subsequent operation of the device, during rotation of the rotor (e.g., to effect low-frequency magnetic communication), the determined current levels can then be applied through the coil(s) when the orientation of the rotor matches the corresponding rotor orientation. This can include detecting the rotor orientation and responsively applying the corresponding current level. Alternatively, the rotor can be controlled in a feed-forward fashion, applying a set of current levels determined as described above in order to cause the rotor to rotate and levitate (e.g., in a manner analogous to feed-forward control of brushless DC motors). In an example embodiment using a 5 cm long, 5 mm diameter permanent magnet rotor, coil currents for a set of 16 equally spaced angles were determined. High rotational speeds may be achieved by accelerating or increasing the speed at which the rotor currents, for each of the angles, are applied. Levitated rotors typically exhibit resonances in the levitating magnetic field. These resonances may constrain the range of speeds of rotation of the rotors, e.g., by causing the rotor to contact the walls of a cylindrical or otherwise-configured cavity within which the rotor is disposed when the rotor is rotated at or near such resonant frequencies. Accordingly, the coil current can be controlled to accelerate the rotor speed quickly to rotational speeds higher than such resonances, such that the motion of the rotor again becomes stable. For the embodiment using the 5 cm long rotor with 16 defined angles described above in a diamagnetic cavity (such as the one shown in FIG. 2B), the rotor was accelerated from 0 Hz rotation to 80 Hz rotation in 0.5 s, at which point it was beyond the magnetic resonances and rotated in a stable manner.

The magnitude of the oscillating magnetic field generated by an apparatus as described herein may be increased by increasing the amount of magnetic material in the permanent magnetic rotor(s) of the apparatus. However, increasing the amount of magnetic material in a particular permanent magnet rotor by increasing the radius of the permanent magnet rotor can result in an increase in the rotational inertia of the permanent magnet rotor. Such an increase in rotational inertia can reduce the efficiency and/or increase the power required to bring the permanent magnet rotor up to a specified rotational speed and/or to modulate the rotational speed of the permanent magnet rotor (e.g., to effect communication with a remote device via modulation of the oscillating magnetic field generated thereby). In order to increase the efficiency and/or reduce the power requirements of such a device, the magnetic material of the device could be distributed across multiple permanent magnet rotors that are substantially parallel to each other (i.e., that have axes of rotation that differ with respect to angle by less than 15 degrees). Such permanent magnet rotors could have respective coil(s) disposed nearby to affect the rotation, levitation, and/or stabilization of the permanent magnet rotors. An array of such permanent magnet rotors could be arranged in a two-dimensional array (e.g., the rotors could be arranged parallel to each other in a single plane) or in a three-dimensional array (e.g., the rotors could be arranged parallel to each other in a hexagonal array). Rotors of such an array could rotate in the same direction. Alternatively, the rotors of such an array could rotate in different directions, e.g., in alternating directions along a two-dimensional array of rotors.

Figure 3A:
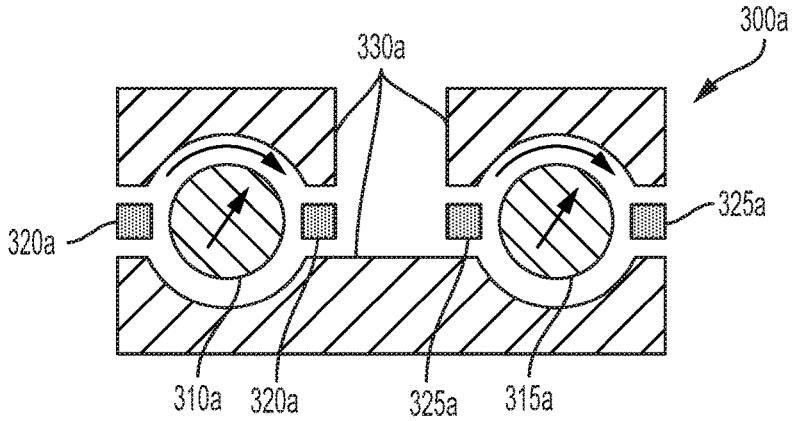
FIG. 3A is a cross-sectional view of elements of an example transmitter system.

Aspects of such a multi-rotor apparatus are illustrated in FIG. 3A, which is a cross-sectional view of a device 300*a* that includes a first permanent magnet 310*a*, a second permanent magnet 315*a*, a first coil 320*a*, and a second coil 325*a*. The device also includes a diamagnetic material 330*a* to levitate the permanent magnets 310*a*, 315*a* and/or to stabilize the location of the permanent magnets 310*a*, 315*a* within the device 300*a*. The permanent magnets 310*a*, 315*a* have a cylindrical geometry and are magnetized in a direction perpendicular (or otherwise non-parallel) to their axes of rotation (illustrated by the arrows in FIG. 3A) such that, when the permanent magnets 310*a*, 315*a* are rotated about their axes of rotation, their magnetic fields are also rotated, generating an oscillating magnetic field that oscillates in time with the rotation of the permanent magnets 310*a*, 315*a*. The coils are configured such that, when currents are passed through the coils 320*a*, 325*a*, torques are exerted on the respective permanent magnets 310*a*, 315*a*, thus causing the permanent magnets 310*a*, 315*a* to rotate about their respective axes of rotation (corresponding to the long axes of the permanent magnets 310*a*, 315*a*).

Figure 3B:
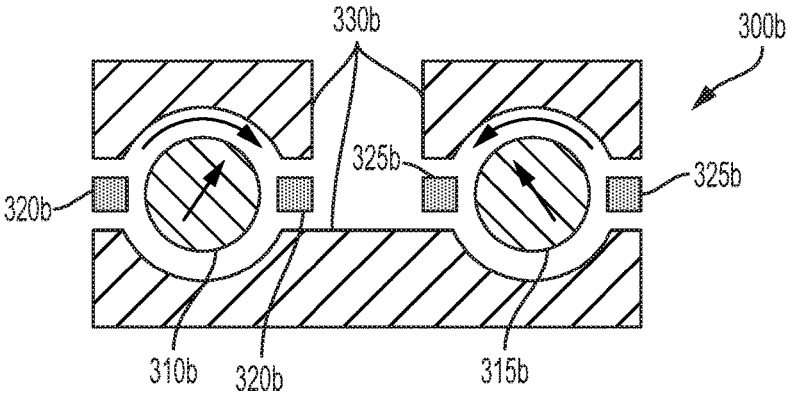
FIG. 3B is a cross-sectional view of elements of an example transmitter system.

As shown in FIG. 3A, the coils can be operated to rotate the magnets in the same direction. Alternatively, such coils can be operated to rotate such magnets in opposite directions. This is illustrated in FIG. 3B, which shows, in cross-section, a device 300*b* that includes a first permanent magnet 310*b*, a second permanent magnet 315*b*, a first coil 320*b*, and a second coil 325*b*. The device also includes a diamagnetic material 330*b* to levitate the permanent magnets 310*b*, 315*b* and/or to stabilize the location of the permanent magnets 310*b*, 315*b* within the device 300*b*. Electrical currents are applied through the coils 320*b*, 325*b* such that the permanent magnets 310*b*, 315*b* rotate in opposite directions (illustrated by the arrows in FIG. 3B).

When the magnets of a multi-rotor device rotate in the same direction, the oscillating magnetic field generated thereby will, at a distance from the device, appear substantially similar to a rotating dipolar magnetic field. When the magnets of a multi-rotor device rotate in opposite directions (e.g., in alternating directions across a two-dimensional array of permanent magnet rotors), the oscillating magnetic field generated thereby may, with respect to the device, have a more directed nature. For example, the magnitude (e.g., the RMS magnitude) of the generated oscillating magnetic field may be greater in some directions (e.g., along the direction of the plane of the two-dimensional array of rotors) relative to the device than in other directions.

Additionally, the profile of the time-varying magnetic forces between permanent magnet rotors that are rotating in the same direction, as compared to the forces between rotors that are rotating in opposite directions, can differ. The attractive/repulsive magnetic force between opposite-rotating permanent magnet rotors can vary in magnitude, over time, less than the force between permanent magnet rotors that re rotating in the same direction. This varying force could be compensated for by, e.g., controlling the currents through coils associated with the rotors to apply stabilizing forces and/or using bias magnets acting on radially-magnetized portions of the rotors to apply stabilizing forces. Additionally or alternatively, an additional, smaller permanent magnet rotor could be disposed between two larger permanent magnet rotors and could rotate in a direction opposite the direction of rotation of the larger rotors. Thus, stabilizing time-varying attractive and repulsive magnetic forces could be exerted between the smaller rotor and the two larger rotors. Such an additional rotor could have a corresponding coil disposed proximate thereto that could be used to drive the rotation of the smaller rotor. Additionally or alternatively, the forces from the larger rotors could drive the rotation of the smaller rotor.

Figure 3C:
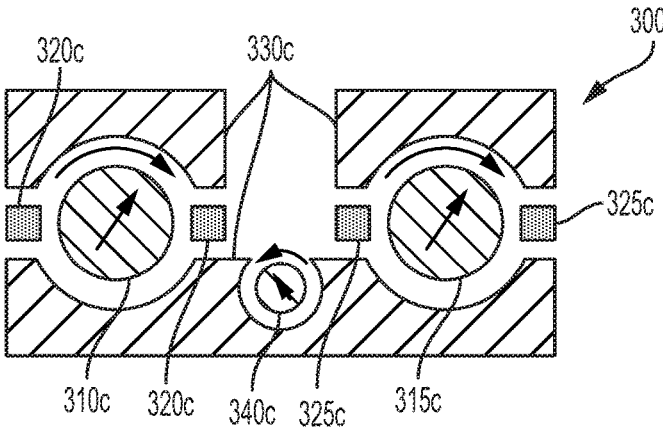
FIG. 3C is a cross-sectional view of elements of an example transmitter system.

Aspects of such a multi-rotor apparatus, which includes an additional stabilizing rotor, are illustrated in FIG. 3C, which is a cross-sectional view of a device 300*c* that includes a first permanent magnet 310*c*, a second permanent magnet 315*c*, a third permanent magnet 340*c*, a first coil 320*c*, and a second coil 325*c*. The third permanent magnet 340*c* is smaller in radius, and in overall mass of magnetic material, than the first 310*c* and second 315*c* permanent magnets. The device also includes a diamagnetic material 330*c* to levitate the permanent magnets 310*c*, 315*c*, 340*c* and/or to stabilize the location of the permanent magnets 310*c*, 315*c*, 340*c* within the device 300*c*. Electrical currents are applied through the coils 320*c*, 325*c* such that the permanent magnets 310*c*, 315*c* rotate in the same direction while the smaller, third permanent magnet 340*c* rotates in the opposite direction (illustrated by the arrows in FIG. 3C).

Additionally or alternatively, the overall magnitude and/or amplitude of the variation over time of forces exerted between the rotors of a multi-rotor device may be reduced by increasing the distance between the rotors within the device. Such a course of action will, however, result in a corresponding increase in the overall size of the multi-rotor device.

The magnetic fields applied, via respective sets of one or more coils, to rotate, levitate, and/or stabilize the location of permanent magnet rotors in a multi-rotor apparatus may be individually controlled for each of the permanent magnet rotors. That is, one or more controllers could, for each of the rotors individually, determine and apply suitable electrical currents through the respective coil(s) (e.g., using respective digital-to-analog converters, amplifiers, filters, or other electronic components). Such operation could be based on the output of respective sensors (e.g., magnetic sensors, optical sensors) configured to detect the rotation, location, or other properties of the individual permanent magnet rotors.

Additionally or alternatively, multiple rotors of a multi-rotor device could be controlled in-common by having their respective coils connected in series. In such a device, similarities in the environment of the multiple rotors having their coils connected in series (and thus receiving the same current applied through those coils), as well as the stabilizing effects of diamagnetic materials or other passive stabilizing elements of the device, can result in the multiple rotors having substantially the same orientation and location respective to their relative specified locations within the device. Controlling multiple rotors of a device in such a manner could allow for the overall cost and complexity of the device to be reduced, e.g., by allowing only a single one of the controlled-in-common rotors to have sensors disposed proximate thereto for generating feedback information about the orientation and relative location of the single rotor and/or by reducing a number or a computational power of the controller(s) present in the device to determine the electrical currents applied to the coils of the multi-rotor device.

Figure 3D:
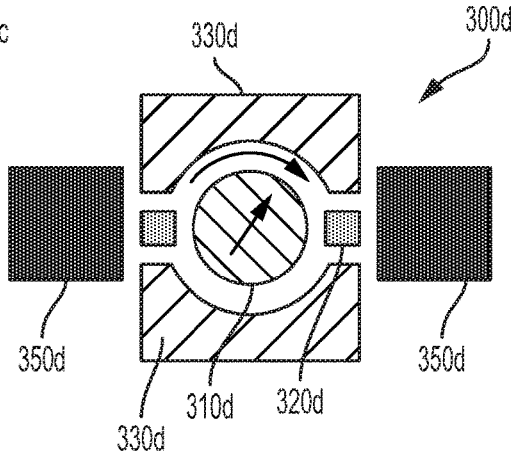
FIG. 3D is a cross-sectional view of elements of an example transmitter system.

Another method to increase the magnitude of the oscillating magnetic field generated by the rotation of a permanent magnet rotor is to disposed ferromagnetic materials (e.g., ferromagnetic poles) proximate to the permanent magnet rotor. The rotation of the permanent magnet rotor proximate to the ferromagnetic material can result in a time-varying magnetization in the ferromagnetic material. This time-varying magnetization can add to the time-varying magnetic field generated by the rotation of the permanent magnet rotor, resulting in an increase in the magnitude of the total oscillating magnetic field generated by the rotation of the permanent magnet rotor. This is illustrated in FIG. 3D, which is a cross-sectional view of a device 300*d* that includes a permanent magnet 310*d*, a coil 320*d*, and a ferromagnetic material 350*d*. The device also includes a diamagnetic material 330*d* to levitate the permanent magnet 310*d* and/or to stabilize the location of the permanent magnet 310*d* within the device 300*d*. Such a ferromagnetic material may also provide stabilizing magnetic forces to a permanent magnet rotor, e.g., to a permanent magnet rotor that is located at the edge of an array of permanent magnet rotors. Ferromagnetic materials described herein may include low-loss ferrite materials, which can be advantageous because they are resistive electrically (resulting in reduced eddy current losses) and have low hysteresis (resulting in reduced hysteretic losses).

Figure 4:
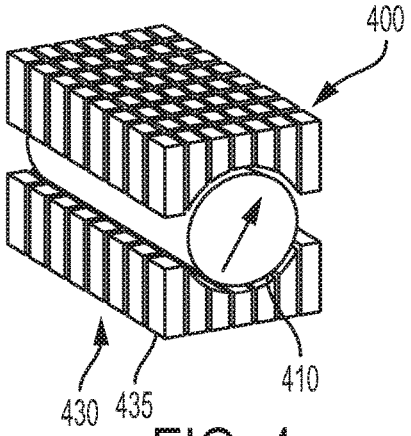
FIG. 4 is a perspective view of elements of an example transmitter system.

Note that diamagnetic materials used as described herein (e.g., pyrolytic graphite, bismuth) may have non-negligible electrical conductivity. Accordingly, the rotation of a permanent magnetic rotor nearby may result in the generation of eddy currents in the diamagnetic material, leading to a decrease in the efficiency of the apparatus. In order to increase the efficiency of such an apparatus, the diamagnetic material may be diced in one or more directions in order to reduce eddy current losses within the diamagnetic material while maintaining the diamagnetic repulsive effect of the diamagnetic material. Aspects of an apparatus containing a diamagnetic material diced in this way are shown by way of example in FIG. 4, which shows a diametrically-magnetized permanent magnet 410. A diamagnetic material 430 is disposed proximate to the permanent magnet 410 such that a levitating force is exerted between the permanent magnet 410 and the diamagnetic material. The diamagnetic material is diced along two perpendicular directions into a plurality of segments (including example segment 435) to reduce eddy currents that may be produced in the diamagnetic material 430 as a result of rotation of the permanent magnet 410.

The segments may be electrically separated from each other by sheets of nonconductive material, by a non-conductive adhesive, or by some other means for reducing or preventing electrical currents from passing between the segments of the diamagnetic material. The diamagnetic material 430 can be diced into the segments via a variety of processes, e.g., by using a wire saw to cut a single piece of diamagnetic material into the illustrated segments. As the segments become smaller, eddy current losses may be reduced, though the levitational effect of the diamagnetic material may also be reduced. Lamination techniques, such as those used to construct electrical transformers, may be additionally or alternatively be applied to reduce eddy current losses in the diamagnetic material 430.

In the embodiments described above, the permanent magnet rotors are shaped as cylinders that have lengths that are greater than their diameters; such permanent magnet rotors can be referred to as "rod-shaped." Devices containing such rod-shaped rotors can be configured such that, during normal operating conditions, the rotational axes of the rotors are substantially perpendicular to the direction of gravity. Alternatively, cylindrical permanent magnet rotors can have lengths that are less than their diameters; such permanent magnet rotors can be referred to as "disc-shaped." Devices containing such disc-shaped rotors can be configured such that, during normal operating conditions, the rotational axes of the rotors are substantially parallel to the direction of gravity.

Figure 5:
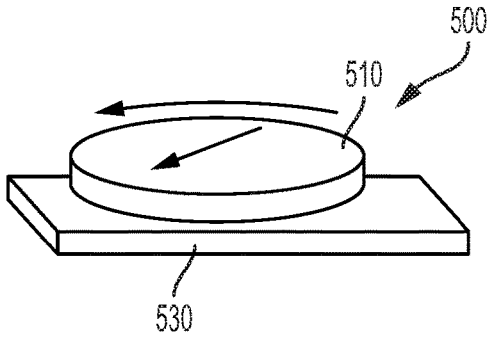
FIG. 5 is a perspective view of elements of an example transmitter system.

Elements of an apparatus containing such a disc-shaped rotor is illustrated in FIG. 5, which is a perspective view of elements of a device 500 that includes a permanent magnet rotor 510, a diamagnetic material 530, and at least one coil (not shown). The permanent magnet rotor 510 has a cylindrical geometry and the coil is configured such that, when a current is passed through the coil, a torque is exerted onto the permanent magnet rotor 510, thus causing the permanent magnet rotor 510 to rotate about an axis of rotation corresponding to the axis of geometrical symmetry of the permanent magnet rotor 510. The permanent magnet rotor 510 has a net magnetic moment in a direction perpendicular (or otherwise non-parallel) to this axis of rotation (illustrated by the arrow in FIG. 5) such that, when the permanent magnet rotor 510 is rotated about its axis of rotation, its net magnetic field is also rotated, generating an oscillating magnetic field that oscillates in time with the rotation of the permanent magnet rotor 510.

Figure 6A:
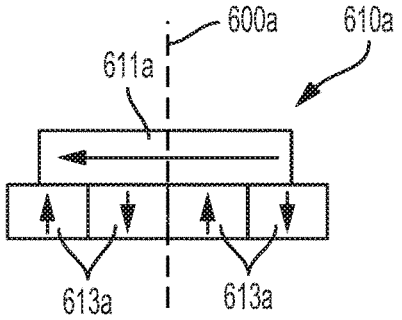
FIG. 6A is a perspective view of elements of an example transmitter system.
Figure 6B:
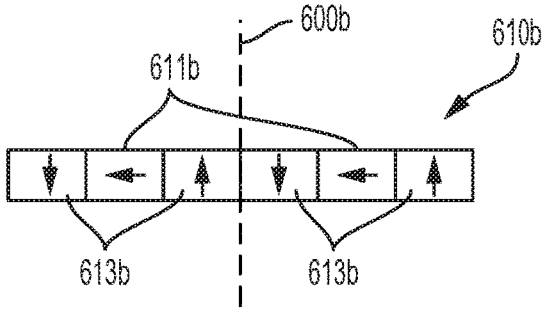
FIG. 6B is a perspective view of elements of an example transmitter system.

In order to increase the efficiency with which such a disc-shaped permanent magnet rotor may be rotated and/or to stabilize the location of such a rotor within an apparatus, an amount of diamagnetic material (e.g., diamagnetic material 530) may be disposed proximate to the disc-shaped permanent magnet rotor. In order to increase the magnitude of the levitational and/or stabilizing forces exerted between such a rotor and such a diamagnetic material, the permanent magnet rotor could include multiple permanent magnet elements having dipole moments directed in respective different directions. This could include a diametrically-magnetized permanent magnet element of the rotor being disposed on, and mechanically coupled to (e.g., via a layer of adhesive), a plurality of other permanent magnet elements having their dipole moments directed into or out of the underlying diamagnetic material in order to increase the repulsive force generated between the diamagnetic material and the magnetic elements of the rotor. This is illustrated by way of example in FIG. 6A, which shows a permanent magnet rotor 610*a* in a cross-section through an axis of rotation 600*a* of the permanent magnet rotor 610*a*. The direction of magnetization of the permanent magnet elements of the rotor 610*a* are indicated in FIG. 6A by the arrows. The permanent magnet rotor 610*a* includes a diametrically-magnetized permanent magnet element 611*a* and a number of axially-magnetized permanent magnet elements 613*a*. In another example, the diametrically-magnetized permanent magnet element(s) could be interspersed in a single layer with the axially-magnetized permanent magnet element(s). This is illustrated by way of example in FIG. 6B, which shows a permanent magnet rotor 610*b* in a cross-section through an axis of rotation 600*b* of the permanent magnet rotor 610*b*. The direction of magnetization of the permanent magnet elements of the rotor 610*a* are indicated in FIG. 6A by the arrows. The permanent magnet rotor 610*b* includes diametrically-magnetized permanent magnet elements 611*b* and a number of axially-magnetized permanent magnet elements 613*b*.

Figure 6C:
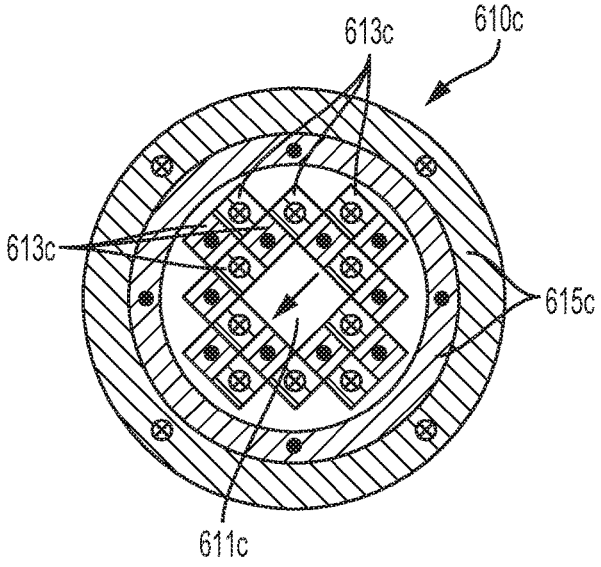
FIG. 6C is a perspective view of elements of an example transmitter system.

Other configurations of a disc-shaped permanent magnet rotor are possible. Such a rotor could include one or more permanent magnet elements disposed at and/or along the periphery of the rotor, so as to even out the repulsive and/or attractive magnetic forces exerted between the rotor and other permanent magnet rotors as the permanent magnet rotors rotate (e.g., in response to magnetic fields generated by respective coils of a device that includes the permanent magnet rotors). This is illustrated by way of example in FIG. 6C, which shows a permanent magnet rotor 610*c* in a cross-section perpendicular to an axis of rotation of the permanent magnet rotor 610*c*. The direction of magnetization of the permanent magnet elements of the rotor 610*c* are indicated in FIG. 6C by the arrows, crosses and dots. Crosses indicate directions of magnetization into the plane of the figure, and dots indicate directions of magnetization out of the plane of the figure. The permanent magnet rotor

610*c* includes a diametrically-magnetized permanent magnet element 611*c* and a number of axially-magnetized permanent magnet elements 613*c* within a central region of the rotor 610*c*. The rotor 610*c* also includes ring-shaped permanent magnet elements 615*c* disposed at the periphery of the rotor 610*c*. The attractive and/or repulsive effects of these peripheral elements 615*c* could have a greater effect on neighboring rotors than the inner elements 611*c*, 613*c*, resulting in an effective attractive and/or repulsive magnetic force between the rotor 610*c* and such other rotors that is more even as the rotor 610*c* rotates about its axis of rotation.

In an experimental implementation of the embodiments described herein, a single-rotor device was constructed having a coil arrangement as in FIGS. 2E and 2F, each coil formed from between 10 and 30 turns of wire. The cylindrical, diametrically-magnetized permanent magnet rotor was 50 millimeters along it long axis with a diameter of 5 millimeters. An amount of diamagnetic material (pyrolytic graphic) was also included to provide stabilizing and levitating forces to the rotor. This experimental device was able to achieve a rotational speed of 1 kHz, expending 3.3 watts to maintain this speed and 33 joules in order to reach this speed from a stop. At this speed, the device was able to produce a magnetic field with an RMS strength, at 1 kilometer's distance, of 0.15 femtoteslas. The device was able to achieve a modulation rate of the speed of rotation of 100 hertz/second, and the energy required to modulate the speed of rotation of the rotor was 0.033 joules/hertz. The overall device dimensions, not inclusive of driver electronics, was a maximum linear dimension of 7 centimeters, a volume of 41 cubic centimeters, and a weight of 0.1 kilograms.

III. Example Systems

Figure 7:
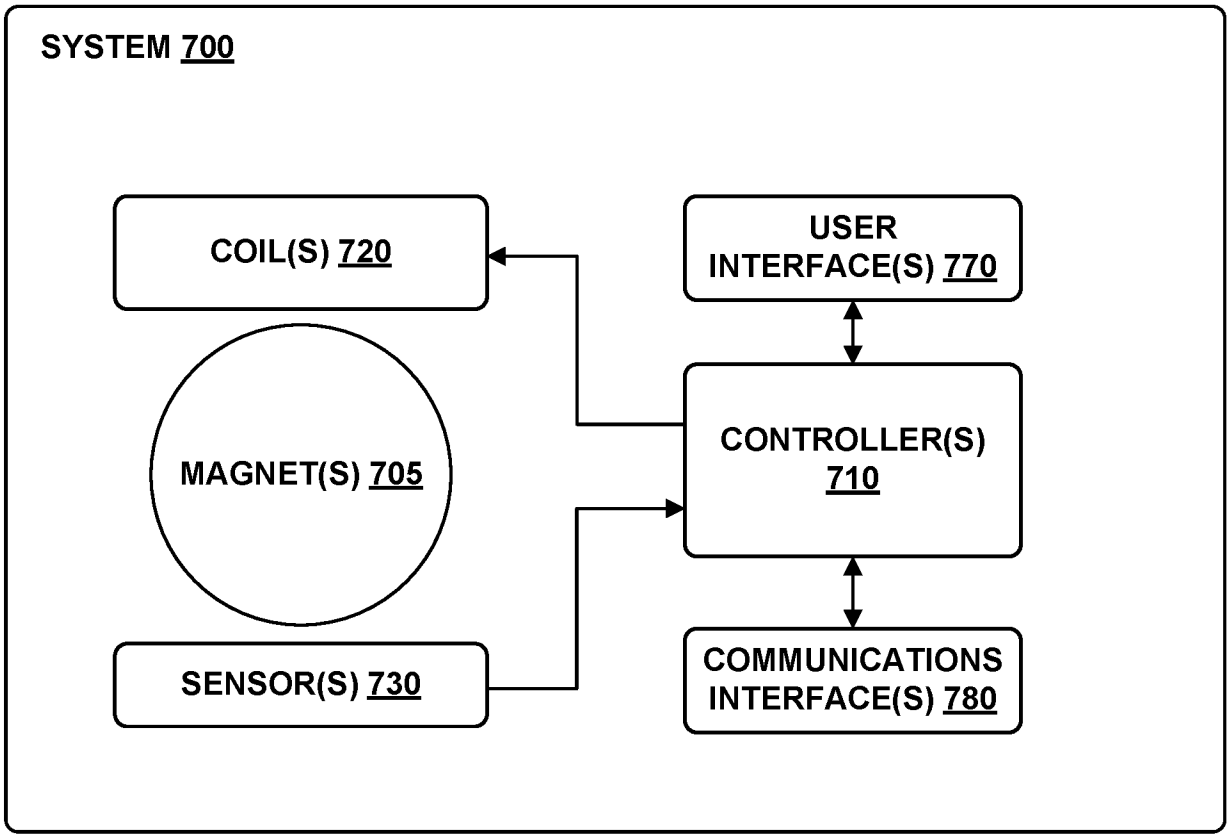
FIG. 7 is a functional block diagram of an example system.

FIG. 7 is a simplified block diagram illustrating the components of a transmitter system 700, according to an example embodiment. Transmitter system 700 may take the form of or be similar to apparatus 100 shown in FIGS. 1A and 1B. However, transmitter system 700 may also take other forms, such as a multi-rotor transmitter. The transmitter system 700 could include elements similar to disc- or rod-shaped permanent magnet rotors, biasing magnets, coils, sensors, PCBs, diamagnetic materials, ferromagnetic materials, or other elements described herein and/or could include other elements according to an application.

In this example, transmitter system 700 includes one or more controller(s) 710, one or more permanent magnet rotors 705, one or more coils 720 disposed proximate to each of the one or more permanent magnet rotors 705, one or more sensors 730 for detecting the orientation, position, or other properties of the one or more permanent magnet rotors 705, one or more user interface(s) 770, and one or more communications interface(s) 780. The transmitter system 700 may additionally include other elements, e.g., batteries for portably powering the transmitter system 700, additional sensors for detecting the motion of the transmitter system 700 and/or the direction of gravity relative thereto, one or more magnetometers, search coils, or other magnetic-field-detecting elements to facilitate two-way communication via low-frequency oscillating magnetic fields (e.g., a spin exchange relaxation-free (SERF) magnetometer or some other magnetometer having a resolution at or near the femtotesla scale), or some other additional elements.

Controller(s) 710 may include general-purpose processor(s), a special purpose processor(s) (e.g., digital signal processors, application specific integrated circuits, etc.), or combinations thereof. The one or more controllers 710 can be configured to execute computer-readable programs that are stored in a non-transitory computer readable medium disposed in the transmitter system 700 (not shown) and that are executable to provide the functionality of the transmitter system 700 described herein. Additionally or alternatively, the controller(s) 710 could execute instructions received from an outside system using the communications interface(s) 780. The instructions could include descriptions of application programming interfaces (APIs) or other protocols to allow functions of the transmitter system 700 (e.g., transmitting modulated low-frequency oscillating magnetic fields) to be monitored, initiated, altered, or otherwise interacted with by a remote system communicating with the transmitter system 700 through some communications channel (e.g., a smartphone application communicating with the transmitter system 700 through the communications interface(s) 980).

Controller(s) 710 may be disposed at various locations in or on the transmitter system 700 according to an application. For example, one of the controller(s) could be disposed proximate to the coil(s) 720 and/or the sensor(s) 730 to facilitate high-bandwidth, low-latency control of the speed of rotation and/or location of the permanent magnet rotor(s) 705 relative to the coil(s) 720. The controller(s) 710 could be configured in ways related to their location and/or function in the transmitter system 700. For example, a controller disposed near the coils(s) 720 and/or sensor(s) 730 could be an FPGA or ASIC while a controller configured to coordinate all of the elements of the transmitter system 700 (e.g., to operate the user interface 770 to receive text strings and then to modulate the speed of rotation of the rotor(s) 705 to transmit an indication of the text strings via a modulated oscillating magnetic field generated thereby) could be a more multi-purpose processor (e.g., ARM, PIC, x86). Further, the program instructions executed by individual controllers of the controller(s) 710 could be specific to the individual controllers. For example, a controller disposed to enable functions of the user interface(s) 770 may execute program instructions containing descriptions of the user interface elements and methods for conveying information to/from other controllers, while a controller disposed to enable control of the permanent magnet rotor(s) 705 may execute program instructions that define a real-time operating system (RTOS) and PID controller that enable fixed-latency updates of any coil 720 or other actuator control outputs generated by the controller.

The user interface(s) 770 could include buttons, screens, touchpads, indicator lights, joysticks, or other elements configured to present information to a user of the transmitter system 700 and/or to receive commands or other information from the user. The user interface(s) 770 could be operated to allow the user to select a mode of operation of the transmitter system 700, to adjust one or more parameters of the transmitter system 700, initiate a function of the transmitter system 700 (e.g., to generate a constant-frequency oscillating magnetic field, to modulate the frequency of an oscillating magnetic field in order to transmit information), or to otherwise input information to the transmitter system 700. For example, the user interface(s) 770 could include a touchscreen that could be operated to receive text information (e.g., messages) that could be indicated, via modulating of the speed of rotation of the permanent magnet rotor(s) 705, to one or more remote systems by generating a corresponding oscillating magnetic field that is modulated (e.g., frequency modulated, phase modulated) to represent the text information. In another example, the user interface(s) 770 could be used to pair the transmitter system 700 with another system (e.g., via a Bluetooth wireless link, a WiFi wireless link, an Ethernet wired link, a CANbus wired link, or via some other communication channel provided, e.g., by the communications interface(s) 780) and/or to set an operational mode of the transmitter system 700 (e.g., to set an operational mode wherein the transmitter system 700 receives a modulation signal from another system, via the communications interface(s) 780, and modulates the speed of rotation of the permanent magnet rotor(s) 705 accordingly).

The communications interface(s) 780 could be any component or components configured to enable elements of the transmitter system 700 (e.g., controller(s) 710) to send and/or receive information to/from some other system or systems. For example, the communications interface(s) 780 could include a radio transceiver configured to transmit and/or receive data to/from a remote device (e.g., a computer, a cellphone, a piece of mining equipment, a wearable computing device, a sensor telemetry system) telemetry data (e.g., exosuit 900 operations, physiological data about a wearer). The communications interface(s) 780 could be configured to communicate over wired and/or wireless media. The communications interface(s) 780 could include radios, Bluetooth transceivers, WiFi transceivers, LTE or other cellular communications equipment, satellite uplinks, ZigBee transceivers, IRdA or other optical communications elements, or some other components configured to enable communications between elements of the transmitter system 700 (e.g., controller(s) 710) and some remote system.

The communications interface(s) 780 could be operated to enable the transmitter system 700 to receive a modulation signal, e.g., an analog or digital representation of a commanded speed of the permanent magnet rotor(s) 705 over time, an indication of a message to be transmitted by modulating the speed of the permanent magnet rotor(s) 705 over time, or some other modulation signal. In examples wherein the transmitter system 700 also includes a magnetometer for detecting low-frequency oscillating magnetic fields (e.g., transmitted by other system configured as described herein), the communications interface(s) 780 could be operated to communicate with another system such that the transmitter system 700 can act as a modem for the other system, granting the other system access to two-way communication via transmitted and/or received modulated low-frequency oscillating magnetic fields.

IV. Example Methods

Generating Low Frequency Oscillating Magnetic Fields

Figure 8:
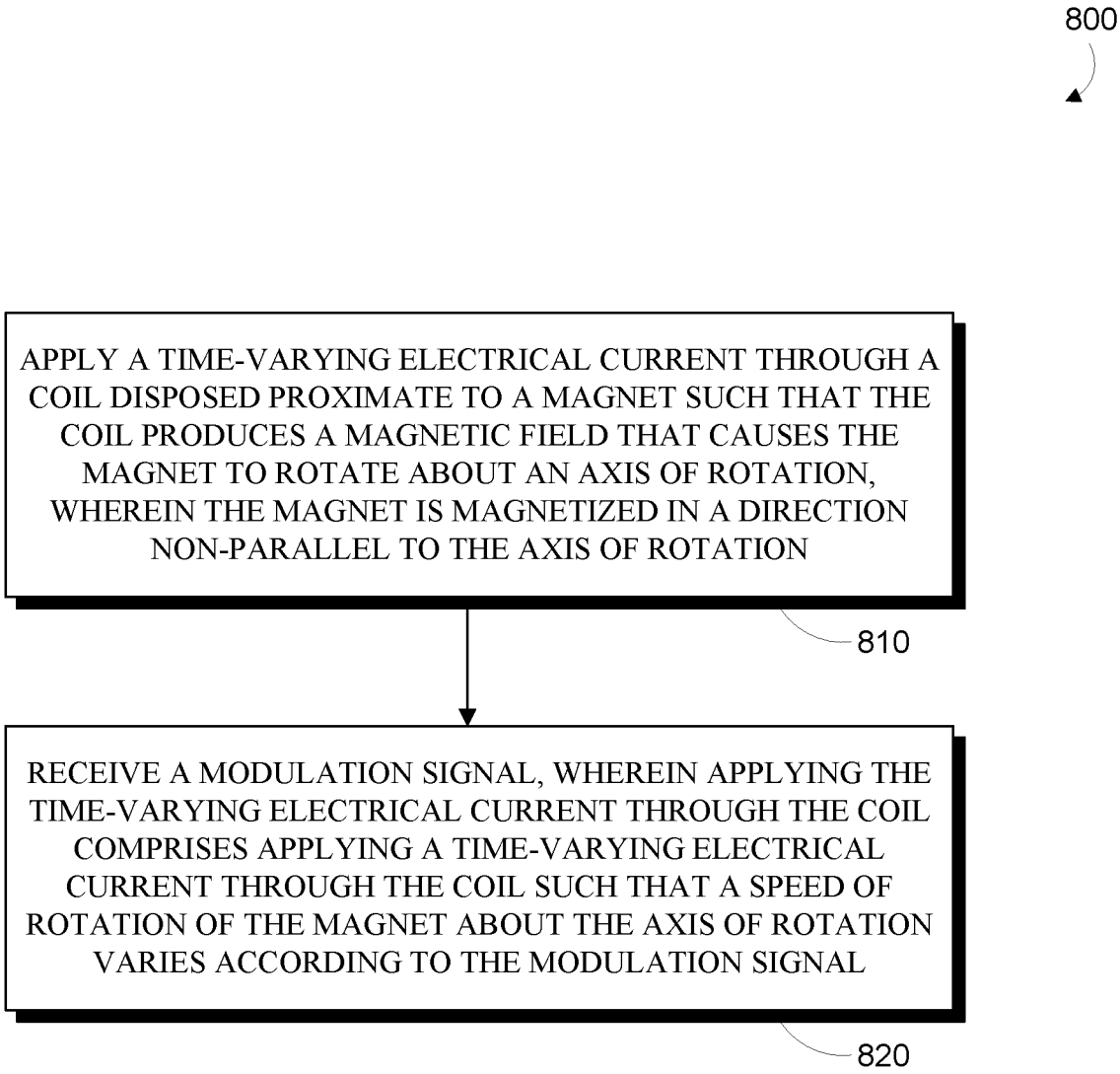
FIG. 8 is a flowchart of an example method.

FIG. 8 is a flowchart of a method 800 for efficiently generating low-frequency oscillating magnetic fields (e.g., magnetic fields that oscillate at a frequency below the Low Frequency (LF) band, which spans frequencies between 30 kHz and 300 kHz). The method 800 includes applying a time-varying electrical current through a coil disposed proximate to a magnet such that the coil produces a magnetic field that causes the magnet to rotate about an axis of rotation, wherein the magnet is magnetized in a direction non-parallel (e.g., perpendicular) to the axis of rotation (810). This can include applying a time-varying current through a single coil or applying a time-varying current through multiple coils, e.g., to levitate and/or stabilize the location of the magnet in addition to rotating the magnet. In some examples, a magnetic, optical, or other type of sensor could be used to detect an orientation, location, or other property of the permanent magnet and/or of the environment of the permanent magnet and the applied current could be specified according to the detected property or properties.

The method 800 additionally includes receiving a modulation signal, wherein applying the time-varying electrical current through the coil comprises applying a time-varying electrical current through the coil such that a speed of rotation of the magnet about the axis of rotation varies according to the modulation signal (820). The modulation signal could be a digital signal or an analog signal. The modulation signal could indicate a speed of rotation of the magnet, and applying a time-varying electrical current through the coil such that a speed of rotation of the magnet about the axis of rotation varies according to the modulation signal could include applying a time-varying electrical current through the coil such that the speed of rotation of the magnet corresponds to the indicated speed of rotation. Additionally or alternatively, the modulation signal could provide an indication of text, sounds, images, or other information (e.g., the modulation signal could be modulated to encode a text string according to a specified encoding protocol) and applying a time-varying electrical current through the coil such that a speed of rotation of the magnet about the axis of rotation varies according to the modulation signal could include applying a time-varying electrical current through the coil such that the speed of rotation of the magnet corresponds to an encoded or otherwise modulated indication of the indicated text, sound, images, or other information (e.g., according to a phase- and/or frequency-modulated encoding of the indicated information). The method 800 could include additional elements or features.

Methods for Tuning the Rotation and Levitation of a Permanent Magnet Rotor

A variety of methods can be employed in order to determine the time-varying currents to apply to one or more coils of a device as described herein in order to rotate a permanent magnet rotor, to wholly or partially counteract the force of gravity on such a rotor, and/or to stabilize or otherwise control the location of such a rotor within a device. Such methods can include methods for "tuning" the current levels applied through coils of a device for a plurality of different orientations, relative to the device, of a permanent magnet rotor of the device. An example tuning procedure is provided below that may be applied to tune a device configured as described in relationship with FIG. 2F. However, this example tuning procedure can be extrapolated to other system configurations.

When tuning an apparatus, the apparatus may be placed in a magnetic cancellation box. While this is not required for tuning, cancellation of ambient magnetic fields can allow for easier determination of the tuned current values. Initially, the orientation of each of the coils may be verified to ensure the expected sign of the related fields, as a function of the sign of the applied current, is consistent. This can be accomplished by experimentally measuring the torque that each coil applies to the rotor (e.g., by optically, magnetically, or otherwise measuring a rotation of the rotor). Fields can be measured with a three-axis magnetic field sensor or optically by observing the rotor(s) directly. One possible starting point is with the rotor oriented such that the direction of magnetization of the rotor is at 90 degrees relative to the direction of gravity. This configuration has low complexity as only one coil is needed to levitate the object (e.g., the first coil 221*e* of the device 200*e* depicted in FIGS. 2E and 2F). With the use of a sensor, sensors, and/or cameras, the current was increased until the rotor began to rise. At this point, the currents applied to the split coils were adjusted independently to counteract any torque experienced (i.e. to apply fields, via the coils of the front and back sets of coils, such that a torque applied to the rotor maintained the rotor at the 90 degree orientation). Next, currents opposite those determined for the 90 degree orientation were applied as a starting point for tuning the coil currents for the 270 degree orientation. The previous tuning steps were then repeated to lift and levitate the rotor.

To determine coil currents for the 0 degree orientation (i.e., the orientation wherein the direction of the dipole moment of the rotor is directed upward and parallel to the direction of gravity), currents were applied only to the side coils (e.g., the second 225*e* and third 227*e* coils of the device 200*e* depicted in FIGS. 2E and 2F). That is, currents were not applied to the top vertical lift coils (e.g., the first coil 221*e* depicted in Figured 2E and 2F). An increasing current was applied until the rotor levitated. The applied currents were adjusted such that the rotor was leveled and centered with respect to the coils. Then a 90 degree orientation pulse was applied before applying currents opposite those determined for the 0 degree orientation. This was done to rotate the rotor to a 180 degree orientation, at which point the current values for the 180 degree orientation were refined as described above.

Once current values for the 0, 90, 180, and 270 degree orientations were obtained, linear superposition was used to determine current values for intermediate orientations (e.g. by determining an equal linear combination of the currents for the 0 degree and 90 degree orientation to obtain current values for a 45 degree orientation). These derived current values for intermediate orientations could be used as-is or could be used as a starting point for continued tuning at the intermediate orientations (e.g., using methods similar to those described above). This process was then repeated to obtain current values for additional intermediate orientations, such as 135 degrees, 225 degrees, 315 degrees, and so on. In this example, eight orientations were obtained via linear combination followed by additional tuning.

Once eight current values were obtained for eight equally-spaced orientations, additional current values for additional intermediate orientations were obtained using curve fitting of all of the current values obtained thus far. Further tuning was then performed, based on these additional current values, for about 16-32 intermediate orientations. The objective was to determined current values for evenly spaced points around the rotation curve to ensure uniform angular velocity during rotation of the rotor. Once all the current values for a full rotation were found, these currents were then used to generate waveforms to power the amplifiers, which were used to accelerate the rotor to full speed.

It should also be appreciated that while above method of tuning the system can be achieved through manual means or automatically. Automatic tuning may be achieved using sensor(s) installed to determine the position of the rotor and corresponding currents. Thus, the entire process of finding new current values associated with various orientations may be performed automatically.

V. Conclusion

The particular arrangements shown in the Figures should not be viewed as limiting. It should be understood that other embodiments may include more or less of each element shown in a given Figure. Further, some of the illustrated elements may be combined or omitted. Yet further, an exemplary embodiment may include elements that are not illustrated in the Figures.

Additionally, while various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are contemplated herein.

What is claimed is:

1. An apparatus for efficiently generating penetrating, time-varying magnetic fields at frequencies below the Low Frequency (LF) band, the apparatus comprising:

a magnet configured to rotate about an axis of rotation of the magnet, wherein at least a portion of the magnet is magnetized in a direction non-parallel to the axis of rotation;

a first coil, wherein the first coil is disposed proximate to the magnet such that a first electrical current through the first coil produces a magnetic field that causes the magnet to rotate about the axis of rotation, wherein the first coil includes a first portion and a second portion spaced apart from the first portion, and wherein the first electrical current goes through the first and second portions of the first coil in different directions;

a second coil, wherein the second coil is disposed proximate to the magnet such that a second electrical current through the second coil produces a magnetic field that causes the magnet to rotate about the axis of rotation, wherein the second coil includes a first portion and a second portion spaced apart from the first portion, and wherein the second electrical current goes through the first and second portions of the second coil in different directions;

a third coil, wherein the third coil is disposed proximate to the magnet such that a third electrical current through the third coil produces a magnetic field that causes the magnet to rotate about the axis of rotation, wherein the third coil includes a first portion and a second portion spaced apart from the first portion, and wherein the third electrical current goes through the first and second portions of the third coil in different directions, wherein the first portion of the second coil is disposed between the first and second portions of the first coil, wherein the second portion of the third coil is disposed between the first and second portions of the first coil, and wherein the magnet is disposed between the second and third coils; and a controller, wherein the controller is configured to apply the first, second, and third electrical currents through the first coil, the second coil, and the third coil, respectively, to rotate the magnet about the axis of rotation, to levitate the magnet, and to stabilize the location of the magnet relative to the first, second, and third coils.

2. The apparatus of claim 1, further comprising:

a diamagnetic material disposed proximate to the magnet and configured to levitate the magnet.

3. The apparatus of claim 2, wherein the diamagnetic material comprises pyrolytic graphite.

4. The apparatus of claim 1, wherein a portion of the magnet is radially magnetized, and wherein the apparatus further comprises:

a bias magnet, wherein the bias magnet is disposed proximate to the radially magnetized portion of the magnet such that the bias magnet levitates the magnet.

5. The apparatus of claim 1, wherein the magnet is a first magnet, and wherein the apparatus further comprises:

a second magnet configured to rotate about an axis of rotation of the second magnet, wherein the second magnet is magnetized in a direction non-parallel to the axis of rotation of the second magnet, and wherein the axis of rotation of the second magnet is substantially parallel to the axis of rotation of the first magnet; and a further coil, wherein the further coil is disposed proximate to the second magnet such that an electrical current through the further coil produces a magnetic field that causes the second magnet to rotate about the axis of rotation of the second magnet.

6. The apparatus of claim 1, wherein the controller is further configured to modulate a speed of rotation of the magnet about the axis of rotation.

7. The apparatus of claim 1, further comprising:

a sensor, wherein the controller is configured to operate the sensor to detect a location of the magnet relative to the first, second, and third coils and to apply the first, second, and third electrical currents through the first, second, and third coils, respectively, based on the detected location of the magnet, to control a magnitude of a force applied, via the first, second, and third coils, to levitate the magnet in order to maintain the magnet at a specified location relative to the first, second, and third coils.

8. The apparatus of claim 1, further comprising:

a ferromagnetic material, wherein the ferromagnetic material is disposed proximate to the magnet such that rotation of the magnet induces a time-varying magnetization in the ferromagnetic material.

9. The apparatus of claim 1, wherein the magnet comprises a cylinder of magnetized material, wherein the axis of rotation is along a long axis of the cylinder, and wherein the cylinder has a diameter less than three millimeters.

10. The apparatus of claim 1, wherein the magnet comprises a cylindrical shape having a long axis, and wherein the axis of rotation of the magnet corresponds to the long axis.

11. The apparatus of claim 1, wherein the magnet has an axis of geometrical symmetry, and wherein the axis of rotation of the magnet corresponds to the axis of geometrical symmetry.

12. The apparatus of claim 1, wherein the magnet has a length, and wherein the first and second portions of the first coil extend along the length of the magnet, the first and second portions of the second coil extend along the length of the magnet, and the first and second portions of the third coil extend along the length of the magnet.

13. The apparatus of claim 12, wherein the first electrical current goes through the first and second portions of the first coil in opposite directions, wherein the second electrical current goes through the first and second portions of the second coil in opposite directions, and wherein the third electrical current goes through the first and second portions of the third coil in opposite directions.

14. A method for efficiently generating penetrating, time-varying magnetic fields at frequencies below the Low Frequency (LF) band, the method comprising:

applying a first electrical current through a first coil disposed proximate to a magnet such that the first coil produces a magnetic field that causes the magnet to rotate about an axis of rotation of the magnet, wherein the magnet is magnetized in a direction non-parallel to the axis of rotation, wherein the first coil includes a first portion and a second portion spaced apart from the first portion, and wherein the first electrical current goes through the first and second portions of the first coil in different directions;

applying a second electrical current through a second coil disposed proximate to the magnet such that the second coil produces a magnetic field that causes the magnet to rotate about the axis of rotation, wherein the second coil includes a first portion and a second portion spaced apart from the first portion, and wherein the second electrical current goes through the first and second portions of the second coil in different directions; and applying a third electrical current through a third coil disposed proximate to the magnet such that the third coil produces a magnetic field that causes the magnet to rotate about the axis of rotation, wherein the third coil includes a first portion and a second portion spaced apart from the first portion, wherein the third electrical current goes through the first and second portions of the third coil in different directions, wherein the first portion of the second coil is disposed between the first and second portions of the first coil, wherein the second portion of the third coil is disposed between the first and second portions of the first coil, and wherein the magnet is disposed between the second and third coils.

15. The method of claim 14, further comprising:

receiving a modulation signal, wherein applying the first electrical current through the first coil comprises applying the first electrical current through the first coil based on the modulation signal such that a speed of rotation of the magnet about the axis of rotation varies according to the modulation signal.

16. The method of claim 14, wherein the magnet is a first magnet, and wherein the method further comprises:

applying an electrical current to a further coil such that the further coil produces a further magnetic field, wherein the further coil is disposed proximate to a second magnet that is configured to rotate about an axis of rotation of the second magnet and that is magnetized in a direction non-parallel to the axis of rotation of the second magnet such that the produced further magnetic field causes the second magnet to rotate about the axis of rotation of the second magnet in a direction opposite a direction of rotation of the first magnet, wherein the axis of rotation of the first magnet and the axis of rotation of the second magnet are substantially parallel.

17. The method of claim 14, wherein the magnet is a first magnet, and wherein the method further comprises:

applying an electrical current to a further coil such that the further coil produces a further magnetic field, wherein the further coil is disposed proximate to a second magnet that is configured to rotate about an axis of rotation of the second magnet and that is magnetized in a direction non-parallel to the axis of rotation of the second magnet such that the produced further magnetic field causes the second magnet to rotate about the axis of rotation of the second magnet in a direction that is the same as a direction of rotation of the first magnet, wherein the axis of rotation of the first magnet and the axis of rotation of the second magnet are substantially parallel.

18. The method of claim 14, wherein the method further comprises applying the first, second, and third electrical currents through the first coil, the second coil, and the third coil, respectively, to rotate the magnet about the axis of rotation, to levitate the magnet, and to stabilize the location of the magnet relative to the first, second, and third coils.

19. The method of claim 18, further comprising operating a sensor to detect a location of the magnet relative to the first, second, and third coils, wherein applying the first, second, and third electrical currents through the first coil, second coil, and third coil, respectively, to levitate the magnet comprises applying the first, second, and third currents through the first, second, and third coils, respectively, based on the detected location of the magnet, to control a magnitude of a force applied, via the first, second, and third coils, to levitate the magnet in order to maintain the magnet at a specified location relative to the first, second, and third coils.

20. The method of claim 14, wherein applying the first electrical current through the first coil comprises applying the first electrical current through the first coil such that a speed of rotation of the magnet exceeds 1000 rotations per second.

* * * * *